United States Patent [19]

Fahmi

[11] 4,366,909

[45] Jan. 4, 1983

[54] CLOTHES HANGER WITH MULTIPLE CLOTHES SUPPORTS

[76] Inventor: Ibrahim Fahmi, Lewrenzstr. 119, 4150 Krefeld, Fed. Rep. of Germany

[21] Appl. No.: 247,407

[22] Filed: Mar. 25, 1981

Related U.S. Application Data

[62] Division of Ser. No. 67,302, Aug. 17, 1979, Pat. No. 4,278,177.

[30] Foreign Application Priority Data

Aug. 21, 1978 [DE] Fed. Rep. of Germany ... 7824917[U]

[51] Int. Cl.[3] ..... A47F 5/01

[52] U.S. Cl. ..... 211/116; 211/119; D6/247

[58] Field of Search ..... 211/113, 116, 118, 119; D6/247, 256, 252; 223/88, 95

[56] References Cited

U.S. PATENT DOCUMENTS

| | | | |
|---|---|---|---|
| D. 148,407 | 1/1948 | Cleary | D6/252 X |
| D. 193,598 | 9/1962 | Raver | 223/88 UX |
| 2,723,765 | 11/1955 | Meredith | 211/119 |
| 3,088,597 | 5/1963 | Ritchey | 211/119 X |
| 3,370,715 | 2/1968 | Kolozsvari | 211/116 |
| 3,951,270 | 4/1976 | Kiss | 211/119 |
| 4,029,212 | 6/1977 | Vadiski | 211/113 |

FOREIGN PATENT DOCUMENTS

| | | | |
|---|---|---|---|
| 7529103 | 1/1976 | Fed. Rep. of Germany UX | 211/119 |

*Primary Examiner*—Roy D. Frazier
*Assistant Examiner*—Robert W. Gibson, Jr.
*Attorney, Agent, or Firm*—Toren, McGeady and Stanger

[57] ABSTRACT

A clothes hanger with multiple clothes supports is formed of a pair of U-shaped members each having a bight portion and two leg portions. The leg portions form the upper and lower clothes supports extending laterally from the bight portion with other struts fixed to the bight portion between the leg portions and forming the remaining clothes supports. The leg portions and the struts are all located in a single plane. A hook is secured to the end of a support rod which is hingedly connected to the bight portions of the two U-shaped members. The U-shaped members can be pivoted relative to the support rod, held in the vertical position, so that the bight portions can be positioned vertically or horizontally.

3 Claims, 5 Drawing Figures

CLOTHES HANGER WITH MULTIPLE CLOTHES SUPPORTS

This is a division of application Ser. No. 067,302 filed on Aug. 17, 1979 now U.S. Pat. No. 4,278,177, issued July 14, 1981.

SUMMARY OF THE INVENTION

The present invention is directed to a clothes hanger with multiple clothes supports and includes a support rod which can be hung in the vertical position by means of a hook. Transverse struts formed of a bending resistant wire and disposed parallel to one another extend horizontally from the vertically extending support rod and are located in the same plane with the hook. Articles of clothing, folded transversely, such as trousers or skirts, can be hung in a staggered manner one below the other from the struts.

A clothes hanger of this general type is disclosed in German Utility Model No. 75 29 103 and includes a support rod formed from a metal bar with a U-shaped or semicircular cross section with the bent ends of transverse rods inserted into the groove formed in the support rod and fastened by spot-welding. In addition, an upper transverse rod or strut of approximately half the length of the others is fastened to the upper end of the support rod and includes a hook bent upwardly from this top transverse strut. The production of this clothes hanger having multiple clothes supports is cumbersome and expensive, especially since the welding must be performed very carefully if the welded areas are to withstand the unilateral and varying loads acting on the transverse struts. The areas of welding connection are concealed and cannot be visually inspected.

Therefore, it is the primary object of the present invention to provide a clothes hanger having multiple clothes supports of the same general type as above which can be produced with at least the same stability and with significantly less material and labor.

In accordance with the present invention, the clothes hanger is formed of a U-shaped length of bending resistant wire with the bight portion forming the support rod and the leg portions forming the uppermost and lowermost transverse struts extending laterally outwardly from the bight portion. Additional transverse struts formed of rectilinear rods are located between the leg portions in spaced relation to one another and butt-welded to the bight portion by a fusion welding operation.

The welding operation can be performed exactly, quickly and easily by means of a simple pattern guide device. The finished product is clearly visible for inspection.

In such a hanger, the hook can be bent from the free end portion of one of the leg portions of the U-shaped member or it can be attached at approximately the midpoint of one of the leg portions by a butt-welding operation.

It is more advantageous, however, if the hook is bent from one end of a special angularly shaped rod with the other end of the rod connected to the middle of the bight portion of the U-shaped member. The special angular rod is connected to the bight portion so that it can be rotated about an axis which is parallel to the transverse struts. With this arrangement, it is possible to facilitate significantly the placement of clothes on and their removal from the hanger when it is hung up in a position of use with the transverse struts arranged one above the other in a space-saving manner so that the U-shaped member can be rotated 90° relative to the angular rod. In this rotated position, the struts are located next to one another in a horizontal plane so that the articles of clothing can be placed on or removed from the struts without adjacent articles of clothing presenting any interference or being displaced. In addition, the capacity of the hanger can be doubled if the hook is located on one end of a rod-like support member with two U-shaped members hinged on opposite sides of the other end of the support member. For increased stability, the bight portions of the U-shaped members can be connected together by a short section of rod.

To ensure that the hanger will always maintain its given position when the U-shaped member is turned relative to the angular rod independently of the distribution of its load, a specially designed hinge joint is provided between the rod and the U-shaped member.

The hinge joint or connection includes a flange-like disc secured to the end of the angular rod adjacent the U-shaped member with the end portion supporting the disc being bent approximately perpendicularly of the bight portion of the U-shaped member. Another disc is fastened to the mid-part of the bight portion and it is connected so that a space is provided between the bight portion and the disc connected to it. The disc on the bight portion has a central opening through which the end of the angular rod extends with the flange-like disc on the angular rod being positioned between the bight portion and the disc connected to it. Because of the spacing between the bight portion and the disc connected to it, the flange-like disc on the angular rod is held between them with a slight amount of play. When a load is placed on the hanger there is a slight tilting of the U-shaped member relative to the angular rod and friction is developed between the flange-like disc and oppositely located surfaces on the bight portion and the disc connected to it. The amount of friction developed increases with an increasing load on the hanger. If, however, the U-shaped portion of the hanger is to be turned, it is only necessary to lift the U-shaped portion slightly to overcome the friction developed in the hinge connection.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
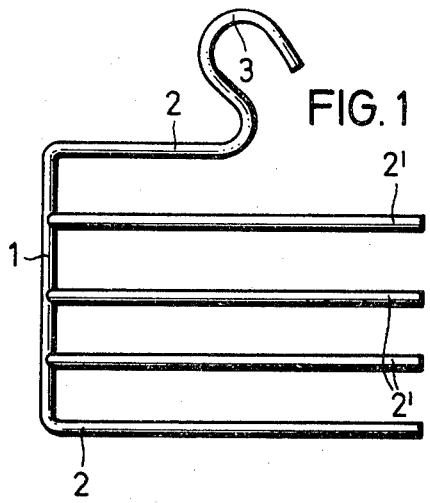
FIG. 1 is a side view of a clothes hanger with multiple clothes supports embodying the present invention.

In each of the embodiments of the clothes hanger illustrated in FIGS. 1, 2, 3 and 5, a U-shaped member formed of a length of bending resistant wire consists of a bight portion 1 and a pair of leg portions 2 extending laterally from the bight portion. One of the leg portions forms an upper transverse strut or clothes support 2 and the other forms the lower transverse strut or clothes support 2 with a number of transverse struts 2' formed of rectilinear sections of the same wire being butt-welded to the bight portion 1 between the leg portions. All of the struts are located in a single plane. A hook 3 for supporting the hanger is attached to the U-shaped portion and is located in the same plane with the transverse struts 2, 2'. While each embodiment has these similar features, there are differences between the embodiments basically involving the manner in which the hook 3 is formed or connected to the U-shaped portion.

In FIG. 1, the hook 3 is formed from the end portion of the upper transverse strut 2 spaced outwardly from the bight portion 1. The hook is located approximately mid-way between the bight portion 1 and the opposite free ends of the transverse struts 2, 2'.

Figure 2:
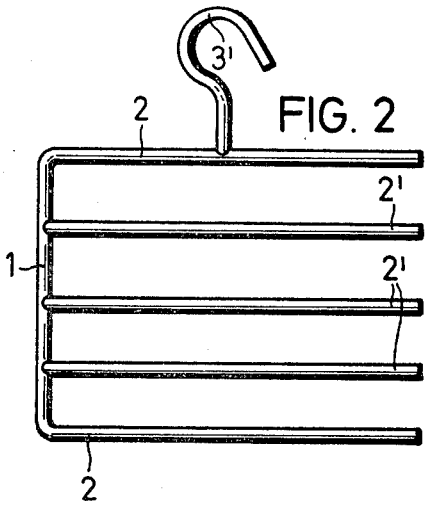
FIG. 2 is a view similar to FIG. 1 of another embodiment of the clothes hanger incorporating the present invention.

In FIG. 2, the hook 3' is formed of a separate hook shaped rod which is butt-welded at one end to the mid-point of the upper transverse strut 2.

Figure 3:
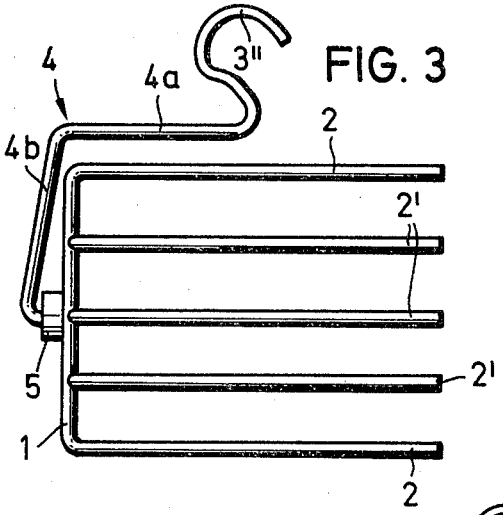
FIG. 3 is a view similar to FIGS. 1 and 2 illustrating yet another embodiment of a clothes hanger incorporating the present invention.

In FIG. 3, the hook 3'' is formed of an angularly shaped rod having a first leg **4*a* and a second leg 4*b*. The hook 3'' is formed in the end of the leg 4*a* spaced from its junction with the leg 4*b*. The legs 4*a*, 4*b* form an obtuse angle. The free end of leg 4*b*, spaced from the junction with leg 4*a*, is bent toward the bight portion 1 and is rotatably connected to the middle of the bight portion between the leg portions 2 by a hinge 5**.

Figure 4:
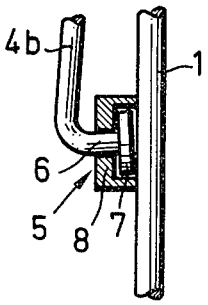
FIG. 4 is an enlarged detail view of a portion of the hanger displayed in FIG. 3.

FIG. 4 illustrates on an enlarged scale and partly in axial section, the hinge 5 between the leg **4*b* and the bight portion 1**.

Figure 5:
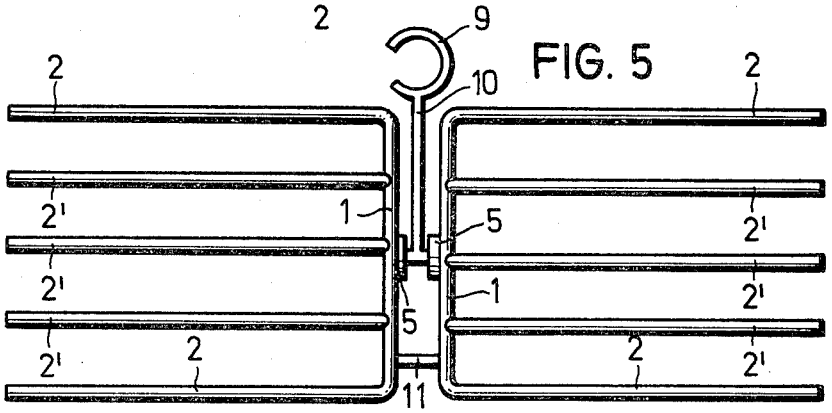
FIG. 5 is a view similar to FIGS. 1–3 illustrating still another embodiment of a clothes hanger incorporating the present invention.

In FIG. 5 a pair of U-shaped members are hinged to a dependent support rod 10.

As can be seen in FIG. 4, the free end of the leg **4*b* is bent relative to the remaining portion of the leg and extends approximately perpendicularly relative to the bight portion 1. This bent free end portion of the leg 4*b* forms a bearing pin 6 with a disc 7 attached to its free end so that the disc provides a flange-like rim projecting radially outwardly from the bearing pin 6. The bearing for pin 6 is formed by a centrally located bore extending through another disc 8. Disc 8 is fastened to the middle part of the bight portion 1 between the leg portions 2 so that a spacing is provided between the bight portion and the adjacent surface of the disc 8. The disc 7 with the flange-like rim is located with a slight amount of play in the space provided between the bight portion 1 and the disc 8. When a load is placed on the hanger formed by the bight portion 1 and the struts 2, the flange-like rim of the disc 7 bears against the disc 8 at its top and against the bight 1 at its bottom, note FIG. 4. Further, under the effect of the load applied to the hanger, the bearing pin 6 is slightly canted in its bearing hole in the disc 8** so that it contacts the surface of the bore at two points located obliquely one above the other.

In the double hanger displayed in FIG. 5, the dependent support rod 10 has a circular shaped hook 9 at its upper end with two U-shaped members located each on an opposite side of the rod. The dependent support rod 10 is connected to each of the bight portions 1 of the U-shaped members by a hinge connection 5. Additionally, to afford increased stability for the double hanger, a short rod 11 extends between the lower ends of the bight portions 1. The hinge connections 5 are located approximately mid-way between the upper and lower portions 2 and the rod 11 is located below the hinge connections and slightly above the lower leg portions 2.

While the material forming the U-shaped members has been referred to as a bending-resistant wire, it can be appreciated that other bending resistant materials can be used which afford the interconnection of the bight portion 1 and the intermediate transverse struts 2'.

While specific embodiments of the invention have been shown and described in detail to illustrate the application of the inventive principles, it will be understood that the invention may be embodied otherwise without departing from such principles.

What is claimed is:

1. Clothes hanger with multiple clothes supports comprising a dependent support rod having a first and second end, a hook formed in the first end of said dependent support rod and spaced from the second end thereof, a pair of U-shaped members each located on an opposite side of said dependent support rod, each U-shaped member being formed of bending-resistant material and having a bight portion and two laterally spaced leg portions, each leg portion having a first end and a second end with the first end of each said leg portion forming a junction with said bight portion and the second end of each said leg portion being spaced outwardly from said bight portion, said bight portion comprising a support rod and said leg portions comprising an upper and lower strut, at least one additional rectilinear strut secured to said bight portion between said leg portions and extending outwardly therefrom, said struts forming the multiple supports for the clothes hanger, said struts formed of a bending-resistant material and secured to and extending horizontally from said support rod when said support rod is arranged vertically, said struts being spaced apart along said support rod and being located in a plane including said hook, means for hingedly connecting the second end of said dependent support rod to said bight portion of each of said U-shaped members at a location spaced from said leg portions extending from said bight portion for pivotally displacing said U-shaped members about an axis extending transversely of said dependent support rod and of said bight portions of said U-shaped members so that with said dependent support rod maintained in the vertical position each of said U-shaped members can pivot about the hinge connection between a position where said bight portion is vertical to a position where said bight portion is horizontal.

2. Clothes hanger, as set forth in claim 1, including a rod secured to and extending between said bight portions of each of said U-shaped members, with said rod spaced from the hinge connection of said dependent support rod to said bight portions.

3. Clothes hanger, as set forth in claim 1, wherein said means for hingedly connecting comprises a section of rod secured to and extending transversely of the second end of said dependent support rod, said section of rod having a first end and a second end with said first end located on the opposite side of said dependent support rod from said second end thereof, a pair of first discs one secured to and extending transversely of said first end of said section of rod and the other secured to and extending transversely of said second end of said section of rod, a pair of second discs each having a bore extending centrally therethrough, said first end of said section of rod extending through one of said second discs and said second end of said section of rod extending through the other one of said second discs with said second discs extending radially outwardly from said section of rod, said one of said first discs being positioned between said one of said second discs and one of said bight portions of said pair of U-shaped members and the other said first disc being positioned between said other second disc and the other bight portion of said pair of U-shaped members, said second discs each being secured to said bight portion on an opposite side thereof from said struts secured thereto and a portion of said second discs being spaced from said bight portion so that a slight amount of play is provided for said first discs located therebetween.

* * * * *